US005399287A

United States Patent [19]

Pichler et al.

[11] Patent Number: 5,399,287

[45] Date of Patent: Mar. 21, 1995

[54] PROCESS FOR THE PRODUCTION OF ZEOLITE GRANULES

[75] Inventors: Werner Pichler, Kundl, Austria; Jochen Jacobs, Wuppertal, Germany

[73] Assignee: Henkel Kommanditgesellschaft auf Aktien, Germany

[21] Appl. No.: 70,442

[22] PCT Filed: Nov. 25, 1991

[86] PCT No.: PCT/EP91/02209

§ 371 Date: Jun. 4, 1993

§ 102(e) Date: Jun. 4, 1993

[87] PCT Pub. No.: WO92/10559

PCT Pub. Date: Jun. 25, 1992

[30] Foreign Application Priority Data

Dec. 4, 1990 [DE] Germany ..... 40 38 609.0

[51] Int. Cl.[6] ..... C11D 3/37; C11D 3/18

[52] U.S. Cl. ..... 252/174.24; 252/174.23; 252/174.25; 252/174.21

[58] Field of Search ..... 252/174.25, 174.23, 252/174.24, 174.21

[56] References Cited

U.S. PATENT DOCUMENTS 4,552,681 11/1985 Koch et al. ..... 252/140
4,707,290 11/1987 Seiter et al. ..... 252/140
4,849,125 7/1989 Seiter et al. ..... 252/109
4,861,503 8/1989 Hollingsworth et al. ..... 252/135
5,024,782 6/1991 Finn et al. ..... 252/174.13
5,178,798 1/1993 Jolicoeur ..... 252/553
5,205,958 4/1993 Swatling et al. ..... 252/174.13

FOREIGN PATENT DOCUMENTS 0149264 7/1985 European Pat. Off. .
0243908 11/1987 European Pat. Off. .
3316513 11/1984 Germany .
3838086 5/1990 Germany .

*Primary Examiner*—Paul Lieberman
*Assistant Examiner*—Kery Fries
*Attorney, Agent, or Firm*—Ernest G. Szoke; Wayne C. Jaeschke; Real J. Grandmaison

[57] ABSTRACT

The object of the invention was to provide a granulation process for the production of heavy zeolite granules in which the quantity of granulation liquid used would be a less critical factor, so that (co)polymeric carboxylates could be used as a dissolved constituent of the granulation liquid. This object is achieved by using a mixture of water, surfactants and (co)polymeric carboxylates as the granulation liquid, the content of surfactants in the granulation liquid being at least 10% by weight.

6 Claims, No Drawings

PROCESS FOR THE PRODUCTION OF ZEOLITE GRANULES

BACKGROUND OF THE INVENTION

1. Field of the Invention

This invention relates to a process for the production of zeolite granules of high apparent density which have a pronounced adsorption capacity for liquid active substances and to the use of the zeolite granules as an intermediate product in the production of detergents.

2. Discussion of Related Art

German patent application 33 16 513 (Benckiser) relates to granules which are produced by spray-drying of aqueous slurries and which contain finely powdered zeolites and salts of (co)polymeric carboxylic acids. They have an apparent density of only 560 to 610 g/l. Granules containing zeolites, salts of (co)polymeric carboxylic acids and, in addition, small quantities of alkali metal silicates, which are used as a support material for liquid detergent constituents, more particularly nonionic surfactants, are described in German patent application 34 44 960. The apparent density of these granules, which are produced by spray drying, is at most 700 g/l and is preferably between 500 and 650 g/l.

Granules containing zeolites and alkali metal silicates which have a particle size of 0.15 to 2 mm and an apparent density of 300 to 700 g/l are known from European patent application 21 267 (PQ). They are also suitable for the adsorption of liquid detergent constituents, particularly nonionic surfactants. For the production of these granules, a dry premix of zeolite and alkali metal silicate (mixing ratio 1:1 to 1:8) is sprayed with water and agglomerated in a granulator, after which the excess water is removed by drying to a residual content of less than 5% by weight. The disadvantage of these granules is, above all, the high content of alkali metal silicates showing a strongly alkaline reaction which severely restricts the use of these granules in detergents showing a neutral to mildly alkaline reaction of the type suitable for delicate fabrics. In addition, apparent densities of more than 700 g/l cannot be obtained in accordance with the teaching of this document. According to European patent application 149 264 (Unilever), commercially available spray-dried zeolites or mixtures thereof with inorganic salts, such as sodium sulfate, can be used for the adsorption of liquid detergent constituents, particularly nonionic surfactants. The apparent density of the relatively finely divided spray-dried products is in the range from 450 to 600 g/l, the particles ranging from 0.05 to 0.5 mm in size.

German patent application 38 38 086 describes the production of granules from zeolite and the sodium or potassium salts of polymeric or copolymeric carboxylic acids, the agglomeration or granulation process taking place with addition of a granulation liquid and the agglomerate obtained being dried to obtain free-flowing granules having an apparent density of 750 to 1,000 g/l. To produce the granules, a homogeneous powder-form mixture of zeolite and the salt of the (co)polymeric carboxylic acids is prepared and granulated in another mixing and granulation stage with addition of water which is preferably sprayed onto the agitated powder mixture. The polycarboxylates are initially introduced in solid form and are not added in dissolved form as part of the granulation liquid because the quantity of granulation liquid used is a critical factor and, accordingly, has to be exactly measurable. Excessive quantities of granulation liquid lead to granules having a broad particle size distribution and an undesirably large coarse component (particle size above 2 mm in length (and also to a relatively low apparent density.

DESCRIPTION OF THE INVENTION

It has now been found that the quantity of granulation liquid is a far less critical factor so that the (co)polymeric carboxylates may be used as a dissolved constituent of the granulation liquid providing certain process steps are carried out.

The present invention relates to a process for the production of granules of zeolite and sodium or potassium salts of polymeric or copolymeric carboxylic acids, the granulation process taking place with addition of a granulation liquid and the granules obtained being dried to form free-flowing granules having an apparent density of 750 to 1,000 g/l, characterized in that a mixture of water, surfactants and (co)polymeric carboxylates is used as the granulation liquid, the content of surfactants in the granulation liquid being at least 10% by weight.

The production of the granules best starts out from spray-dried, finely powdered zeolite which generally has a water content of 17 to 25% by weight. Suitable zeolites are those of the zeolite A type. Mixtures of zeolite NaA and NaX may also be used, the content of zeolite NaX in such mixtures best being below 30%. Preferred zeolites contain no particles larger than 30 μm in size, 80% of the zeolites consisting of particles smaller than 10 μm in size. The zeolites are of detergent quality. In addition to zeolite powder as such, spray-dried zeolite powder mixtures (products of Degussa, trade name Wessalith), which contain small quantities of additives, such as sodium sulfate, salts of nitrilotriacetic acid, sodium hydroxide, carboxymethyl cellulose, (co)polymeric carboxylates or nonionic surfactants, are also suitable. In one preferred embodiment, the zeolite is partly used in the form of a 45 to 55% by weight aqueous suspension. More particularly, 5 to 30% by weight zeolite, based on the total quantity of zeolite, are initially introduced in the form of an aqueous suspension and 95 to 70% by weight, based on the total quantity of zeolite, in powder form. This water component and also the water content of the powder-form zeolite are included in the calculation of the water balance; the quantity of water to be introduced into the granulation stage may be reduced by these amounts. Although the zeolite suspensions used normally contain about 1.5 to 3% by weight, based on suspension, of stabilizers, including nonionic surfactants, anionic surfactants or polymeric polycarboxylates, the content of these active substances introduced through the suspension is so small that the effect according to the invention is only achieved by the use of additional quantities of surfactants and (co)polymeric carboxylates. The granules produced by the process according to the invention preferably contain 50 to 95% by weight and, more preferably, 70 to 92% by weight, based on dried granules, of water-containing zeolite.

Suitable water-soluble salts of the homopolymeric and/or copolymeric carboxylic acids present in the granules, of which the sodium salts are preferred, are polyacrylic acid, polymethacrylic acid and polymaleic acid, copolymers of acrylic acid or methacrylic acid with maleic acid or vinyl ethers, such as vinyl methyl ether or vinyl ethyl ether, and with vinyl esters, such as vinyl acetate or vinyl propionate, acrylamide, methacrylamide and with ethylene, propylene or styrene. In copolymeric acids such as these, in which one of the components does not have an acid function, their content is no more than 50 mol % and preferably less than 30 mol % in the interests of adequate solubility in water. Copolymers of acrylic acid or methacrylic acid with maleic acid have proved to be particularly suitable. Copolymers containing 50 to 90% by weight acrylic acid and 50 to 10% by weight maleic acid are particularly preferred. The relative molecular weight of the homopolymeric or copolymeric polycarboxylates is generally in the range from 2,000 to 150,000 and preferably in the range from 5,000 to 100,000. The polycarboxylates are preferably used in the form of 30 to 50% by weight and, more particularly, 35 to 45% by weight aqueous solutions. Water-soluble inorganic salts, for example sodium sulfate, may be added to these solutions in quantities of up to 10% by weight, based on the polycarboxylate used, for the purpose of reducing viscosity. In another embodiment, the polycarboxylates are partly introduced in powder-form together with the finely divided zeolite. In this embodiment, it is preferred to use at most 50% by weight and, more preferably, at most 40% by weight of the polymeric carboxylates in powder form. The commercially available salts of (co)polymeric carboxylic acids in powder form often have moisture contents of 5 to 15% by weight. This water component is also included in the calculation of the water balance. For calculation purposes, the percentage content of salts in the production of the detergents or rather in the composition of the final granules should be based on anhydrous salt. The granules according to the invention preferably contain the salts of the polymeric or copolymeric carboxylic acids in quantities of 2 to 12% by weight and, more preferably, in quantities of 4 to 10% by weight.

The granulation liquid contains at least water as liquid constituent, at least polymeric or copolymeric carboxylates as solid constituent and also anionic and/or nonionic surfactants. The granulation liquid preferably contains a mixture of water and liquid nonionic surfactants as the liquid constituent. 5 to 30% by weight of the granulation liquid advantageously consists of (co)polymeric carboxylate, 10 to 75% by weight of anionic and/or nonionic surfactants and 7 to 70% by weight of water. More particularly, 10 to 25% by weight of the granulation liquid consists of (co)polymeric carboxylate, 10 to 65% by weight of nonionic surfactants or 10 to 40% by weight of anionic surfactants and 10 to 68% by weight water.

Ethoxylated and/or propoxylated fatty alcohols are preferably used as the liquid nonionic surfactants, preference being attributed to the ethoxylated fatty alcohols, more particularly adducts of 2 to 7 mol ethylene oxide (EO) with linear primary alcohols, for example with coconut oil, tallow or oleyl alcohol, or with primary alcohols methyl-branched in the 2 position (oxoalcohols). More particularly, $C_{12-14}$ alcohols containing 3 EO or 4 EO, $C_{13-15}$ alcohols containing 3, 5 or 7 EO, $C_{12-18}$ alcohols containing 2, 3, 5 or 7 EO and mixtures thereof, such as mixtures of $C_{12-14}$ alcohol containing 3 EO and $C_{12-18}$ alcohol containing 5 EO, are used. Other preferred ethoxylated fatty alcohols are narrow range ethoxylates (NRE).

The water-soluble anionic surfactants are alkali metal salts, sodium or potassium salts from the class of sulfonates and sulfates. Preferred surfactants of the sulfonate type are $C_{9-13}$ alkylbenzene sulfonates, more particularly $C_{12}$ alkylbenzene sulfonate, and oleochemical sulfonates, such as the esters of $\alpha$-sulfofatty acids, the sulfo group being present in its salt form (monosalt), for example the $\alpha$-sulfonated methyl esters of hydrogenated coconut oil, palm kernel oil or tallow fatty acids. Other suitable sulfonate surfactants are the readily biodegradable alkane sulfonates obtained from $C_{12-18}$ alkanes, for example by sulfochlorination or sulfoxidation and subsequent hydrolysis or neutralization. The sulfonate group is statistically distributed over the entire carbon chain, the secondary alkane sulfonates predominating. Suitable surfactants of the sulfate type are, for example, the optionally ethoxylated sulfuric acid monoesters of primary alcohols of natural and synthetic origin, i.e. of fatty alcohols, such as for example coconut oil fatty alcohol, tallow fatty alcohol, oleyl alcohol, lauryl, myristyl, cetyl or stearyl alcohol, or the $C_{10-20}$ oxoalcohols and also the sulfuric acid monoesters of secondary alcohols in the same chain length range, the oleochemical sulfuric acid monoesters of primary alcohols being preferred. The solid water-soluble anionic surfactants may be incorporated in powder or paste form in the liquid constituents of the granulation liquid. Where aqueous surfactant pastes are used, the water content is included in the calculation of the liquid constituents, i.e. the quantity of liquid introduced into the granulation stage may be reduced by this amount.

To produce the moist, non-dried granules, granulation liquid is added to 100 parts by weight zeolite, expressed as anhydrous substance, or to a homogeneous mixture of zeolite and salt of polymeric or copolymeric carboxylic acids optionally introduced in powder form in such a quantity that preferably from 15 to 45 parts by weight and, more preferably, from 18 to 40 parts by weight, based on the moist granules, of liquid constituents are present. The amount of free water added, which is not bound as water of crystallization or in comparable form, in the granulation liquid can be very small and is dependent solely upon the quantity and concentration of polymeric or copolymeric carboxylate solution used. However, the granulation liquid preferably contains at least 2 parts by weight, for example 5 to 35 parts by weight and, more preferably, 5 to 25 parts by weight, based on the moist granules, of free water.

Granulation may be carried out discontinuously or continuously in standard mixers and granulators. Suitable granulators are, for example, granulators consisting of a cylindrical container arranged horizontally or inclined towards the horizontal, in the longitudinal axis of which rotates a shaft equipped with mixing tools and transport blades. The granulation liquid may be introduced through the spray nozzle arranged in the wall or on the hollow shaft. Where granulation is carried out continuously, two mixers arranged in tandem may be used, the dry premix or, where an aqueous zeolite suspension is used, the moist premix being prepared in the first mixer and the granulation process itself taking place in the second mixer with addition of the granulation liquid containing surfactant and polycarboxylate. Granulation may also be carried out continuously in one and the same mixer, in which case either the powder streams and/or the powder streams and the zeolite suspension being combined and homogenized in a first mixing zone and, after further transport, the mixture being treated with the surfactant- and polycarboxylate-containing granulation liquid and granulated in a following mixing zone. The granulation liquid is preferably sprayed by nozzles onto the agitated mixture. In this way, it is possible to spray a mixture of all the constituents of the granulation liquid or individual constituents one after the other, more particularly the surfactant-containing constituents, before and after addition of the polycarboxylate solution. Granulation is generally carried out at normal to moderately elevated temperatures, preferably at temperatures of 20° to 40° C., and generally takes 5 to 15 minutes.

Drying may be carried out by introduction of hot gases in a third mixing zone, for example a fluidized bed, or even after removal of the granules from the mixer, for example in a vibrating chute, a free-fall dryer or even in a thin layer on a conveyor belt. The granules are preferably dried in a fluidized bed, the temperature of the granules preferably being between 60° and 85° C. and, more preferably, between 65° and 80° C. Drying is continued until the water added in the granulation stage has been removed to a residual content of less than 5% by weight and preferably less than 3% by weight, based on the dried granules. In addition, water originally introduced with the zeolite or a non-anhydrous (co)-polymeric salt may also be removed during the drying phase. "Overdried" granules such as these can have applicational advantages, for example when added to detergents containing moisture-sensitive active ingredients. However, the zeolite should not be dried to a water content below 18% by weight, based on zeolite, in order to avoid reductions in activity. The water content of the granules is best in a range in which the water-binding capacity of the zeolite is largely saturated, i.e. in which the zeolite has a total water content of 19 to 22% by weight.

The granules preferably have an apparent density of 780 to 980 g/l and, more particularly, 800 to 950 g/l. By virtue of their close packing and their low pore volume, their adsorption capacity for liquid or paste-form detergent constituents, more particularly nonionic surfactants and foam inhibitors, for example paraffin oil or silicone oil, is slightly reduced compared with granular supports of lower specific gravity, but is still between 15 and at most 20% by weight without any significant deterioration in the flowability of the granules. This adsorption capacity, which is still surprisingly high despite the high packing density and the content of nonionic surfactants which may already be present in the granules, is entirely sufficient for the usual applications, more particularly for use as a mixture component in detergents.

The granules obtained by the process according to the invention are distinguished by a particle size distribution in which the fine component (particle diameter below 0.1 mm) is generally below 10% and the coarse component (particle diameter above 2 mm) is generally up to 40%. The fine component is preferably less than 7% and, more preferably, is from 0 to 5% while the coarse component is preferably from 2 to 32%. The coarse and fine components are removed by sieving. The coarse particles are ground and incorporated in the product while the fine components and any dust are returned to the granulation process.

Irrespective of their high packing density and their high content of water-insoluble constituents, the granules surprisingly dissolve rapidly and completely in cold water and do not leave behind any residues in the dispensing compartments of automatic washing machines, i.e. they show very good dispensing behavior. The granules show this advantageous property even after impregnation with nonionic surfactants and in admixture with other powder-form detergent components.

In one preferred embodiment, the granules contain from 2 to 25% by weight surfactants and, more particularly, from 4 to 20% by weight anionic and/or nonionic surfactants. Particularly advantageous granules contain 75 to 90% by weight zeolite, which was initially introduced in powder form or in the form of a mixture of 94 to 73% by weight powder and 6 to 27% by weight, based in each case on zeolite, of an aqueous suspension, 2 to 10% by weight of the sodium salt of a copolymer of acrylic acid and maleic acid and 4 to 20% by weight liquid nonionic surfactants. In another preferred embodiment, the granules contain zeolite as above, 3 to 8% by weight of the sodium salt of a copolymer of acrylic acid and maleic acid and 6 to 11% by weight anionic surfactants, more particularly alkylbenzene sulfonate and fatty alcohol sulfate.

The granules may be impregnated with liquid detergent consituents which could otherwise only be incorporated in typical powder-form or granular detergents with a loss of activity, if at all. These constituents include foam inhibitors, more particularly paraffin hydrocarbons, silicones, silicone resins and bis-acyl alkylenediamines derived from long-chain fatty acids and mixtures thereof. Other adsorbing active substances are fatty acid alkylol amides and cationic plasticizers, such as quaternary ammonium salts containing long-chain fatty residues, and also fat-dissolving solvents, such as terpenes. However, the granules are preferably used as supports for liquid nonionic surfactants and foam inhibitors. "Liquid" constituents are constituents which are present in liquid form at room temperature or at the processing temperature of 25° C. to about 80° C. and preferably up to 75° C. It can be of advantage in this regard to heat constituents which, for example, are liquid but show undesirably high viscosity at room temperature before impregnation of the carrier granules.

Suitable nonionic surfactants are alkoxylation products containing 10 to 20 carbon atoms in the hydrophobic part and 3 to 20 glycol ether groups. Products such as these include ethoxylation products of alcohols, vicinal diols, amines, thioalcohols, fatty acid amides and fatty acids. Block polymers of ethylene oxide and propylene oxide commercially available under the name of Pluronic (BASF/Wyandotte) are also suitable. Alkyl glycosides or alkyl polyglycosides and mixtures thereof with the ethoxylation products mentioned may also be used.

Preferred nonionic surfactants which may be adsorbed on the granules and form a free-flowing mixture with the granules are derived from $C_{12-18}$ alcohols which may be saturated or olefinically unsaturated, linear or methyl-branched in the 2-position (oxo radical). Their reaction products with ethylene oxide (EO) or propylene oxide (PO) are water-soluble or water-dispersible mixtures of compounds having different degrees of alkylation, the number of EO or PO groups shown in the following corresponding to a statistical mean value.

Examples of preferred ethoxylated fatty alcohols are $C_{12-18}$ coconut oil alcohols containing 3 to 12 EO, $C_{16-18}$ tallow alcohol containing 4 to 16 EO, oleyl alcohol containing 4 to 12 EO and ethoxylation products of corresponding chain distribution and EO distribution obtainable from other native fatty alcohol mixtures.

Among the ethoxylated oxoalcohols, those having the composition $C_{12-15}$ with 5 to 10 EO and $C_{14-15}$ with 6 to 12 EO, for example, are suitable. Also suitable are alkoxylates cotnaining EO groups and PO groups, for example $C_{12-18}$ alcohols corresponding to the formula $R—(PO)_a—(EO)_b$ or $R—(EO)_b—(PO)_c$, in which a is a number of 1 to 3, b is a number of 5 to 20 and c is a number of 1 to 10, b being greater than c.

The liquid, optionally heated additives, particularly the nonionic surfactants and the foam inhibitors, may be applied to the granules by mixing and preferably by spraying, the support material best being kept in motion by suitable mixing units. There is no need for further aftertreatment of the granular adsorbate. However, it can be useful to leave the product standing for several hours where large quantities of liquid material are applied because the diffusion of the liquid material into the interior of the granules takes some time. The treatment of the granules with the liquid additives leads to a further increase in apparent density which may rise to values above 1,000 g/l.

After application of the liquid additive, the granules may optionally be dusted or surface-coated with a fine powder as dusting agent. It is possible in this way to improve the flowability of the granules despite high contents of nonionic surfactants exceeding 15% and slightly to increase the apparent density. Suitable dusting agents have a particle size of 0.001 to at most 0.1 mm and preferably smaller than 0.05 mm and may be applied in quantities of 0.03 to 3% by weight and preferably in quantities of 0.05 to 2% by weight, based on the adsorbent charged with additive. Suitable dusting agents are, for example, finely powdered zeolites, silica aerogel (Aerosil®), colorless or colored pigments, such as titanium dioxide. However, there is generally no need for any such aftertreatment, especially since it does not improve the dissolving properties.

The detergent additives may be combined and mixed in known manner with the granular or powder-form detergents, for example granules containing a tower powder and mixtures thereof with other powder components, such as persalts, granular enzymes, bleach activators and foam inhibitors. The high powder density and the favorable dispensing behavior of the additives according to the invention are carried over into these complex mixtures. In practice, the detergents generally contain 10 to 40% by weight of the additive according to the invention.

EXAMPLES

Granulation was carried out in a mixer/granulator (holding capacity 130 l) comprising a rotating shaft equipped with mixing elements rotating in the central axis (Lödige ploughshare mixer) and—connected thereto—a cutter mill operated at a rotational speed of 1,200 to 1,500 r.p.m. The powder-form constituents and, optionally, the aqueous zeolite suspension were initially introduced into the mixer/granulator and processed to form a homogeneous mixture. After mixing, which took approximately 10 seconds to 1 minute, the granulation liquid was sprayed in through nozzle over a period of 1 to 5 minutes and the mixture was granulated for another 1 to 3 minutes with continuous mixing. The granules leaving the mixer were dried with hot, flowing drying gases (70° C.) in a fluidized bed. In all the Examples, the fine component (particle diameter smaller than 0.1 mm) was less than 7% and the coarse component (particle diameter larger than 2 mm) less than 32%.

The zeolite powder used was finely crystalline, spray-dried zeolite of the NaA type which contained 20% by weight bound water. The aqueous zeolite suspension had a concentration of 48% by weight. The sodium salt of the acrylic acid/maleic acid copolymer used (Sokalan® CP5), a product of BASF, Germany) had a relative molecular weight of approx. 70,000 and was used in the form of a 40% by weight solution. The quantities are all based on anhydrous substance.

EXAMPLE 1

100 Parts by weight zeolite, based on anhydrous substance, were sprayed with 49.5 parts by weight of a granulation liquid consisting of 20% by weight Sokalan CP5, 14% by weight $C_{12-18}$ fatty alcohol containing 5 EO and 66% by weight $H_2O$. The granules obtained after drying contained 88.1% by weight anhydrous zeolite, which had been initially introduced in powder form, 7% by weight Sokalan CP5 and 4.9% by weight $C_{12-18}$ fatty alcohol containing 5 EO. The apparent density before sieving was 810 g/l; the coarse component made up 17.3%.

EXAMPLE 2

100 Parts by weight zeolite, based on anhydrous substance, were sprayed with 44.2 parts by weight of a granulation liquid consisting of 19.8% by weight Sokalan CP5, 50.6% by weight $C_{12-18}$ fatty alcohol containing 5 EO and 29.6% by weight water. The granules obtained after drying contained 80.1% by weight water-containing zeolite, which had been initially introduced in powder form, 5.6% by weight Sokalan CP5 and 14.3% by weight $C_{12-18}$ fatty alcohol containing 5 EO. The apparent density before sieving was 900 g/l; the coarse component made up 5%.

EXAMPLE 3

100 Parts by weight zeolite, based on anhydrous substance, were sprayed with 42.5 parts by weight of a granulation liquid consisting of 13.3% by weight Sokalan CP5, 62.1% by weight $C_{12-18}$ fatty alcohol containing 7 EO and 24.6% by weight water. The granules obtained after drying contained 79.6% by weight water-containing zeolite, which had been initially introduced in powder form, 3.6% by weight Sokalan CP5 and 16.8% by weight $C_{12-18}$ fatty alcohol containing 7 EO. The apparent density before sieving was 850 g/l; the coarse component made up 13.9%.

EXAMPLE 4

100 Parts by weight zeolite, based on anhydrous substance, were sprayed with 39 parts by weight of a granulation liquid consisting of 8.9% by weight Sokalan CP5, 73.3% by weight $C_{12-18}$ fatty alcohol containing 7 EO and 17.8% by weight water. The granules obtained after drying contained 79.6% by weight water-containing zeolite, which had been initially introduced in powder form, 2.2% by weight Sokalan CP5 and 18.2% by weight $C_{12-18}$ fatty alcohol containing 7 EO. The apparent density before sieving was 870 g/l; the coarse component made up 2.9%.

EXAMPLE 5

100 Parts by weight zeolite, based on anhydrous substance, were sprayed with 47.5 parts by weight of a granulation liquid consisting of 22.7% by weight Sokalan CP5, 20.5% by weight sodium dodecyl benzenesulfonate and 56.8% by weight water. The granules obtained after drying contained 85.9% by weight water-containing zeolite, which had been initially introduced in powder form, 7.4% by weight Sokalan CP5 and 6.7% by weight sodium dodecyl benzenesulfonate. The apparent density before sieving was 860 g/l; the coarse component made up 30.2%.

EXAMPLE 6

100 Parts by weight zeolite, based on anhydrous substance, were sprayed with 44 parts by weight of a granulation liquid consisting of 11.25% by weight Sokalan CP5, 35.75% by weight sodium dodecyl benzenesulfonate and 53% by weight water. The granules obtained after drying contained 85.8% by weight water-containing zeolite, which had been initially introduced in powder form, 3.4% by weight Sokalan CP5 and 10.8% by weight sodium dodecyl benzenesulfonate. The apparent density was 770 g/l; the coarse component made up 29.8%.

EXAMPLE 7

100 Parts by weight zeolite, based on anhydrous substance, were sprayed with 46.4 parts by weight of a granulation liquid consisting of 20.25% by weight Sokalan CP5, 48.7% by weight $C_{12-18}$ fatty alcohol containing 7 EO and 31.05% by weight water. The granules obtained after drying contained 79.6% by weight water-containing zeolite, of which 74.4% by weight had been initially introduced in powder form and 5.2% by weight in the form of a suspension, 6% by weight Sokalan CP5 and 14.4% by weight $C_{12-18}$ fatty alcohol containing 7 EO. The apparent density before sieving was 940 g/l; the coarse component made up 31.1%.

EXAMPLE 8

100 Parts by weight zeolite, based on anhydrous substance, were sprayed with 42.0 parts by weight of a granulation liquid consisting of 29.5% by weight Sokalan CP5, 22.9% by weight $C_{12-18}$ fatty alcohol containing 5 EO and 47.6% by weight water. The granules obtained after drying contained 76.5% by weight water-containing zeolite, of which 73.1% by weight had been initially introduced in powder form and 13.4% by weight in the form of a suspension, 7.6% by weight Sokalan CP5 and 5.9% by weight $C_{12-18}$ fatty alcohol containing 5 EO. The apparent density before sieving was 830 g/l; the coarse component made up 17.5%.

EXAMPLE 9

100 Parts by weight zeolite, based on anhydrous substance, were sprayed with 41.0 parts by weight of a granulation liquid consisting of 19.5% by weight Sokalan CP5, 31.3% by weight $C_{12-18}$ fatty alcohol containing 7 EO and 49.2% by weight water. The granules obtained after drying contained 85.5% by weight water-containing zeolite, of which 62.5% by weight had been initially introduced in powder form and 23% by weight in the form of a suspension, 5.5% by weight Sokalan CP5 and 8.8% by weight $C_{12-18}$ fatty alcohol containing 7 EO. The apparent density before sieving was 840 g/l; the coarse component made up 24.5%.

Repetition of Examples 1 to 9, in which 40% of the quantity of polymer used was initially introduced in solid form together with the zeolite, produced similar results. The percentage content of water in the granulation liquid could be reduced accordingly.

EXAMPLE 10

The granules of Examples 2, 8 and 9 were sprayed in a spray mixer with a liquid nonionic surfactant heated to 40° C. consisting of a mixture of coconut oil and tallow alcohol in a ratio of 1:4 reacted with 5 mol EO. After standing for 1 hour, the adsorbates had the following apparent densities:

| Example | Nonionic surfactant, % by weight | Apparent density, g/l |
|---|---|---|
| 2 | 15 | 910 |
| 8 | 15 | 880 |
| 9 | 15 | 930 |

The granules treated with nonionic surfactant showed good flow properties and satisfactory dispensing behavior both in the form of an unblended powder and in admixture with a powder-form domestic detergent in a ratio of 1:4.

We claim:

1. The process of preparing zeolite granules having an apparent density of from 750 to 1,000 g/l, comprising granulating said granules in the presence of from 15 to 45 parts by weight of a granulation liquid per 100 parts by weight of zeolite expressed as anhydrous material, said granulation liquid comprising water, surfactants and (co)polymeric carboxylates wherein the content of surfactants in said granulation liquid is at least 10% by weight, and drying the mixture obtained to form free-flowing granules.

2. A process as in claim 1 wherein said zeolite is present in the form of a powder having a water content of from 19 to 22% by weight, or as a mixture comprising 70 to 95% by weight of zeolite in powder form and 5 to 30% by weight of zeolite in the form of a 45 to 55% by weight aqueous suspension.

3. A process as in claim 1 wherein said granulation liquid comprises 5 to 30% by weight of said (co)polymeric carboxylates, 10 to 75% by weight of said surfactants, and 7 to 70% by weight of water.

4. A process as in claim 1 including spraying said granulation liquid onto an agitated mixture of said granules.

5. A process as in claim 4 wherein the individual constituents of said granulation liquid are sprayed simultaneously or successively.

6. A process as in claim 1 wherein said granules have an apparent density of 780 to 980 g/l and contain from 70 to 92% by weight of zeolite, 2 to 12% by weight of said (co)polymeric carboxylates, and 4 to 20% by weight of nonionic surfactant.

* * * * *